United States Patent [19]

Bassoli et al.

[11] 4,167,172

[45] Sep. 11, 1979

[54] DEVICE FOR MONITORING THE LUBRICATION OF THE CRANKSHAFT OF A RECIPROCATING INTERNAL COMBUSTION ENGINE BY MEANS OF A WHEATSTONE BRIDGE

[75] Inventors: Cesare Bassoli; Giorgio Cornetti, both of Turin, Italy

[73] Assignee: Fiat Societa per Azioni, Turin, Italy

[21] Appl. No.: 872,293

[22] Filed: Jan. 25, 1978

[30] Foreign Application Priority Data

Feb. 21, 1977 [IT] Italy ..... 67383 A/77

[51] Int. Cl.[2] ..... F01M 1/00

[52] U.S. Cl. ..... 123/196 S; 184/6.4; 184/24

[58] Field of Search ..... 123/196 S; 184/6.4, 184/24; 73/10, 118, 64

[56] References Cited

U.S. PATENT DOCUMENTS

| | | | |
|---|---|---|---|
| 1,289,903 | 12/1918 | Pogue | 123/196 S |
| 1,788,941 | 1/1931 | Bradley | 123/196 S |
| 1,926,801 | 9/1933 | Christian | 123/196 S |
| 2,337,414 | 12/1943 | Rieber | 73/10 |
| 2,349,563 | 5/1944 | Rouy | 73/10 |

*Primary Examiner*—Ronald H. Lazarus

*Attorney, Agent, or Firm*—Sughrue, Rothwell, Mion, Zinn and Macpeak

[57] ABSTRACT

The lubrication of an engine crank shaft is monitored using a wheatstone resistance measuring bridge one of the arms of which includes lubricating oil ducts between the crank shaft and crank case of the engine, balanced against a reference resistance provided by a resistance measuring cell through which the engine lubricating oil flows. The resistance measuring cell may have an external heater for heating the oil in the cell to a temperature compatible with that of the oil in the engine bearings when the engine is running.

7 Claims, 6 Drawing Figures

DEVICE FOR MONITORING THE LUBRICATION OF THE CRANKSHAFT OF A RECIPROCATING INTERNAL COMBUSTION ENGINE BY MEANS OF A WHEATSTONE BRIDGE

The present invention relates to a device for monitoring the lubrication of the crankshaft of a reciprocating internal combustion engine by means of a Wheatstone bridge.

The Applicants' Italian patent application No. 69882-A/76 describes an apparatus for measuring the lubrication of the crankshaft of a reciprocating internal combustion engine by means of which it is possible to assess the degree of the lubrication of the crankshaft according to whether the device provides an output indication greater or less than a predetermined threshold.

In particular the device according to the aforementioned earlier patent application indicates the degree of efficiency of the lubrication as a function of the time during which the signal provided by a measurement circuit is greater of less than a predetermined thereshold. The measurement circuit includes the lubricating oil ducts of the connecting rod and crank pins. This device provides a measurement of the degree of efficiency of the lubrication which is dependent upon the characteristics of the lubricant.

The object of the present invention is to provide a device for monitoring the lubrication of the crankshaft in a reciprocating internal combustion engine which can afford an accurate measurement independent as far as possible of the characteristics of the lubricant.

According to the present invention there is provided a device for monitoring the lubrication of the crankshaft of a reciprocating internal combustion engine, comprising a measurement assembly which is made up of at least a first measurement unit formed by a first means voltage measuring device and a second measurement unit connected in parallel with said first measurement unit and constituted by a threshold discriminator the output of which is connected to a second means voltage measuring device, wherein the measurement assembly is disposed in the measuring diagonal of a Wheatstone bridge having four arms two of which consist of ordinary resistances while the other two arms comprise respectively a resistance-measuring reference cell which contains the same lubricating oil as the engine and which provides a reference resistance and a resistive circuit having one terminal connected to an element which is electrically connected to the engine crankshaft and another terminal connected to the engine crankcase, said resistive circuit including the lubricating oil in oil passages between the crankshaft and the crankcase.

The invention will now be described, by way of non-limiting example, with reference to the accompanying drawings, in which.

Figure 1:
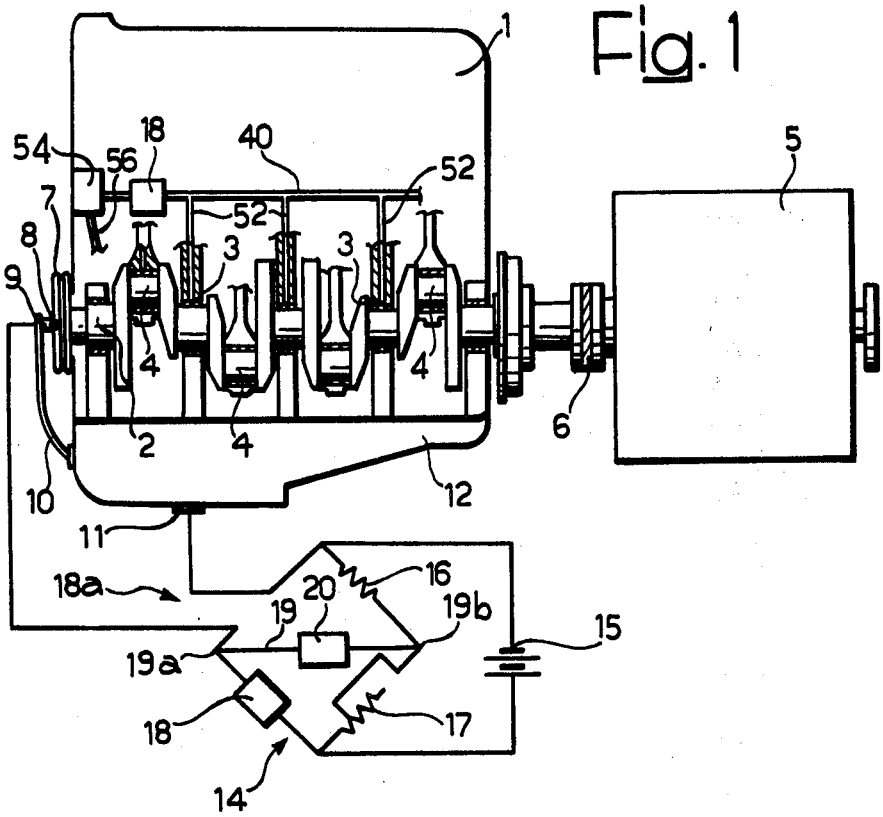
FIG. 1 shows schematically a reciprocating internal combustion engine provided with a system for monitoring its lubrication which incorporates a monitoring device in accordance with one embodiment of the invention, represented diagrammatically.

Referring first to FIG. 1, a reciprocating four-stroke internal combustion engine having four cylinders is shown set up for testing and connected to a test brake. The internal combustion engine is denoted generally by reference numeral 1 and the engine crankshaft is designated reference numeral 1 and the engine crankshaft is designated 2. The crankshaft 2 has main bearings 3 and the four connecting rods of the engine have respective big ends 4 connected to the crankshaft 2.

The right hand end of the crankshaft 2 as shown in FIG. 1, carries a flywheel and is connected to a test brake 5. The coupling between the engine shaft 2 and the shaft of the test brake 5 is preferably such that the engine 1 and the test brake 5 are electrically insulated from one another. For this purpose a disc 6 of electrically insulating material is shown interposed between flanges of the coupling between the engine 1 and the test brake 5. The coupling may include bolts interconnecting the flanges, in which case the bolts should be enclosed in electrically insulating sleeves, not shown.

At its left hand end, opposite the flywheel, the crankshaft 2 is provided with a pulley 7 having a central cavity in which a ball 8 is seated. The ball 8 is in contact with a contact element 9 of carbon or of other electrically conductive material which is urged into contact with the ball 8 by a spring 10 insulated electrically from the engine. Another contact element 11 is fixed and electrically connected to the engine block 12, for example on the oil sump.

A Wheatstone bridge 14, supplied by a direct current source 15 connected across its supply diagonal, has ratio arms formed by two resistances 16 and 17, the latter being in the illustrated embodiment a variable resistance arranged as shown. A third arm of the Wheatstone bridge 14, adjoining the variable resistance 17, is constituted by a resistance measuring reference cell 18, described in detail later, having as its resistive element the oil which is supplied to the lubricating circuit of the engine. The fourth arm of the bridge, indicated 18*a*, consists of the part of the circuit comprised between the engine block 12 and the crankshaft 2 of the engine, terminated by the contact elements 9 and 11. The measuring diagonal 19 of the Wheatstone bridge 14 is connected between junction points 19*a* and 19*b* and is provided with a measuring assembly 20.

Figure 2:
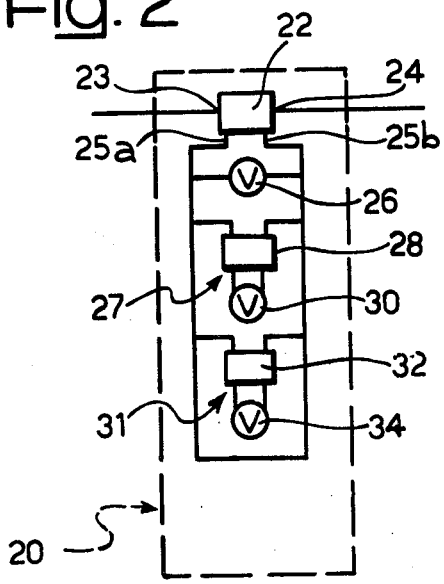
FIG. 2 shows a circuit diagram of a measurement head embodied in the device according to the invention.

The measuring assembly 20 is indicated within a broken line in FIG. 2, which shows the circuit of the assembly 20. The measuring assembly 20 comprises a filter 22 having two inputs 23 and 24 directly connected to the junction points 19*a* and 19 *b* at the ends of the diagonal 19 and three measurement units connected in parallel with each other and each connected between two outputs 25*a* and 25*b* of the filter 22.

The first of the measurement units comprises a millivoltmeter 26 for measuring mean voltage, the second unit 27 comprises a threshold level discriminator the output of which is connected to a millivoltmeter 30 for measuring mean voltage, and the third unit 31 comprises a threshold level discriminator 32 the output of which is connected to a third means voltage measuring millivoltmeter 34.

The discriminators 28 and 32 consist of threshold circuits of known design which provide an output signal of either logic one or logic zero value according to whether the amplitude of the input signals they receive is below or above their predetermined threshold levels.

In the present invention the threshold of the discriminator 28 is higher than that of the discriminator 32, the latter being set at a value slightly above zero.

Figure 3:
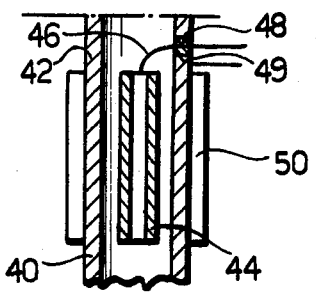
FIG. 3 is a sectional view of an element of the monitoring device according to the invention.

FIG. 3 illustrates the resistive reference cell 18 in longitudinal section. The cell 18 consists of a short length of a duct 40 through which lubricating oil flows on its path into the engine for the lubrication of the main journal bearings 3. The wall 42 of the said duct 40 acts as one electrode of the cell 18. Within the duct 40 there is a second electrode formed by an open-ended hollow cylinder 44, coaxial with the duct wall 42, through which the lubricating oil flows. An electrical conductor 46 is connected to the cylinder 44 and passes out through the wall 42 by way of an aperture 48, the conductor 46 being insulated from the wall 42 by an insulating seal 49 in the aperture 48. A heating element 50 surrounds that part of the wall 42 which is co-extensive with the cylinder 44. The heating element 50 may for example comprise a resistive heater.

The reference cell 18 is preferably positioned as shown in FIG. 1, where the duct 40 comprises an oil distribution duct from which oil is distributed to the bearings 3 through branch ducts 52, the reference cell 18 being disposed downstream of an oil pump 54, and upstream of the branch ducts 52. The pump 54 draws oil from the engine sump, part of which is shown in FIG. 1.

When the engine is runnning the resistance of the fourth arm 18*a* of the bridge 14, which includes the lubricating oil in the passages between the main bearings 3 and the big ends 4 as well, as although less importantly, between the big ends 4 and the piston gudgeon pins, can vary in dependence upon variations in the eccentricity of these components, for which reason the voltages across the sides of the bridge 14 and consequently the voltage across the measuring diagonal 19 of the bridge, tend to vary with time.

It is possible by known methods to evaluate the electrical resistance offered by the lubricating oil in the aforementioned passages as well as the resistance of the reference cell 18, these resistances being dependent upon the thickness of the said passages and on the surface areas of the components which act as electrodes in contact with the oil. Evaluating by this method the resistance denoted by RA, of the arm 18*a* corresponding to nil eccentricity of the crankshaft with respect to the bearings and the resistance, denoted by RB, of the cell 18, these two resistances will determine a ratio $K=RA/RB$.

By varying the resistance 17 the ratio of the resistance 16, denoted by R1, to the resistance 17, denoted by R2 can be made equal to K, corresponding to nil eccentricity of the crankshaft with respect to the bearings, whereupon the bridge 14 will be balanced and the voltage across the measuring diagonal 19 will be zero.

On the other hand, because of variations in eccentricity of the crankshaft which occur during operation of the engine, there will be variations in the resistance of the arm 18*a* of the bridge, so that the voltage across that arm, and consequently the voltage across the diagonal 19, will tend to vary with time. More precisely, under conditions of nil eccentricity the ratio $RA/RB=K$ will be a maximum.

When, during operation of the engine, the eccentricity deviates from zero the value of the ratio K diminishes and the bridge 14 becomes unbalanced, so that the voltage across the measuring diagonal 19 which includes the measuring assembly 20 reaches a magnitude somewhat greater than that which corresponds to zero eccentricity. If the amount of the eccentricity is equal to unity, as may occur when the crankshaft is in contact with one of the worn surfaces on its bearings, the voltage across the measuring diagonal 19 will achieve a maximum VM equal to $(V1 \cdot R1/R1+R2)$, where V1 is the voltage at the source 15.

For intermediate amounts of shaft eccentricity there will be intermediate values of the voltage across the measuring diagonal 19.

Figure 4:
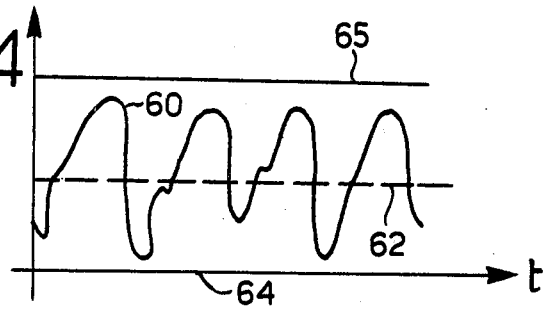
FIGS. 4, 5 and 6 are graphical diagrams showing the variation with time t, represented on the abscissa in each diagram, of signals occurring in different parts of the monitoring device according to the invention.
Figure 5:
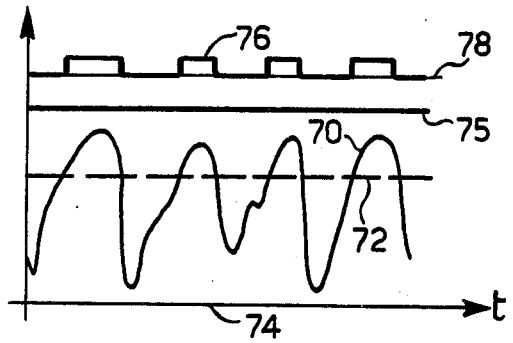
Figure 6:
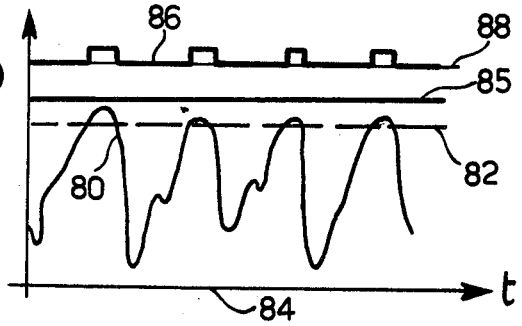

The fluctuating voltage signals at the ends of the diagonal 19 are shown diagrammatically at 60, 70, 80 in FIGS. 4, 5 and 6 respectively.

The operation of the lubrication monitoring system which embodies the measuring device according to the invention will now be described.

An out-of-balance voltage signal across the diagonal 19 is received by the measuring device 20, this signal being represented by ordinates of the graph 60 in FIG. 4 upon which there is superimposed a broken line 62 corresponding to a mean value of this signal as indicated by the millivoltmeter 26. The zero voltage line is indicated by 64, while the maximum value VM of the signal voltage is represented by the line 65.

If the indication of the millivoltmeter 26 is higher than the predetermined threshold value of the discriminator 28 this means that the out-of-balance voltage signal is high, corresponding to a low value of the resistance of the arm 18*a* of the bridge, which includes the lubricating oil in the passages between the crankshaft 2 and the contact 11 on the crankcase. This indicates that the shaft eccentricity is high and that the mean supply of lubricant is weak so that lubrication is defective.

If on the other hand the mean voltage indication of the millivoltmeter 26 is below the threshold value, this means that lubrication is taking place under good conditions insofar as eccentricity of the shaft is not reaching values that might impair the quality of the lubrication.

FIG. 5 represents graphically the amplitude of signals 70 applied to the measurement unit 27 as functions of the time t. The signal 70 is identical to the previous signal 60 and passes into the discriminator 28 which is set at the threshold level indicated by the broken line 72 in FIG. 5, in which 74 denotes the zero line and 75 denotes the line corresponding to the maximum value VM of the signal voltage.

The output from the discriminator 28 is a signal 76 the zero line of which is indicated by 78. The signal 76 is at logic level one when the signal 70 is above the threshold level 72, whereas the output signal 76 is at logic level zero when the signal 70 is below the said threshold level.

The output signal 76 from the discriminator 28 is applied to the millivoltmeter 30 which provides an indication of the mean value of the signal 76, which will be proportional to the percentage of time during which signal 70 exceeds the threshold level 72.

The threshold level 72 of the discriminator 28 is determined experimentally as being the value of the signal 72 for a given type of engine, above which the engine lubrication is found to be defective.

Hence the measurement unit 27 offers an immediate visual indication of the percentage length of time that the lubrication is defective during the running of the engine. The critical value of this length of time beyond which the running of the engine is no longer acceptable needs to be determined by experiment for each type of engine.

FIG. 6 shows graphically the signals applied to the measurement unit 31, represented by voltage variations on the ordinate as a function of the time t. The unit 31 receives a signal 80 which is identical with the signal 60 and which is fed into the discriminator 32 the threshold level of which is set at the value corresponding to the broken line 82, slightly lower than the maximum value VM of the voltage, the zero voltage being indicated in FIG. 6 by the line 84, and the maximum voltage VM by the line 85.

The output from the discriminator 32 is a signal 86 the zero line of which is indicated by 88. The signal 86 has logic level one when the signal 86 is above the threshold level 82 and logic level zero when the signal 86 is below the threshold level 82. The duration of the pulses comprising the signal 86, that is, the length of time the signal is at logic level one, is equal to the time during which the signal 80 exceeds the threshold level 82. An indication of this length of time is given by the mean value of the signal 86.

Thus the signal 86 from the discriminator 32 is fed to the millivoltmeter 34 which measures the mean value of the signal 86 and which consequently provides an output having an amplitude proportional to the percentage of the time during which the signal 80 exceeds the threshold level 82. The setting of this threshold level 82 is so chosen that when the signal 80 exceeds the level 82 it affords an indication that the lubrication of the engine is manifestly defective, due for example to rupture of an oil duct or to some serious impediments to the flow of oil, which may be caused by a blockage of oil passages.

It will be apparent that by the use of the device in accordance with the invention the measurement obtained from the measuring assembly 20 is independent of the characteristics of the lubricating oil employed. In fact, since the reference resistance measuring cell 18 is itself immersed in the oil, any variations in the characteristics of the oil do not influence the measurement.

Moreover the provision of the heating element 50 on the cell 18 enables the cell to be heated through its wall 42, so that the oil flows through the cell at a temperature greater than the average temperature for the flow of oil as a whole, thereby taking into account the rise in temperature of the oil in its passage through the crankshaft bearings 3.

As the various lubricating ducts are electrically connected in parallel to one another, a deficiency of oil in even a single duct suffices to make the resistance in the arm 18*a* of the bridge 14 drop to very low values, thus strongly unbalancing the bridge and resulting in a high value of the signal voltage across the measuring diagonal 19.

It has been found that the signal voltage across the arm 18*a* of the bridge 14 and that applied to the measuring assembly 20 has oscillatory components, due to the behaviour of the gears which transmit the motion of the crankshaft to the oil pump 54. By providing a filter such as the filter indicated at 22 in FIG. 2 these oscillatory components can be eliminated, since they can be separated from the remainder of the signal by analysing the action of the above mentioned transmission gears and shafts with their respective bearings.

The filter 22 may however be dispensed with, in which case the outputs 25*a* and 25*b* would be connected directly to the inputs 23 and 24 respectively.

According to a variant of the invention it is possible to use only one of the two measuring assemblies 27 and 31, by designing the associated discriminator as a circuit having two alternative distinct thresholds corresponding to the threshold levels 72 and 82 of the discriminators 28 and 32 described above. By switching such a discriminator over between each of these thresholds in turn, two successive readings can then be obtained of the percentage of time during which the signal derived from the measuring unit is below the respective values set for the thresholds.

What is claimed is:

1. In a reciprocating internal combustion engine having a crankshaft, crankshaft bearings, a crankcase, and oil passages within the crankcase for the lubrication of the crankshaft bearings, a lubrication monitoring device comprising a measurement assembly made up of at least a first measurement unit formed by a first mean voltage measuring device and a second measurement unit connected in parallel with said first measurement unit and constituted by a threshold discriminator and a second means voltage measuring device connected to the output of said discriminator, wherein the improvement consists in the device further comprising a Wheatstone bridge having four arms, a measuring diagonal and a supply diagonal, the said measurement assembly being included in the measuring diagonal of said Wheatstone bridge, two of the arms of which consist of ordinary resistances while the other two arms comprise respectively a resistance-measuring reference cell which contains the same lubricating oil as the engine and provides a reference resistance, and a resistive circuit having means connecting said resistive circuit electrically between the engine crankshaft and the engine crankcase, said resistive circuit including the engine lubribcating oil in the said lil passages.

2. A lubrication monitoring device as defined in claim 1, wherein the measuring diagonal of the bridge also includes a third measurement unit connected in parallel with the first and second measurement units and comprising a further threshold discriminator having a threshold level set to a different value from the threshold level of the said discriminator of said second measurement unit.

3. A lubrication monitoring device as defined in claim 1, wherein the measuring diagonal of the bridge includes an electrical filter at the input to the said measuring assembly.

4. A lubrication monitoring device as defined in claim 1, wherein the reference cell is provided with a heating element for heating the oil in the cell to a temperature comparable with that of the oil in the engine bearings when the engine is running.

5. A lubrication monitoring device as defined in claim 1, the engine further including an oil pump driven by the engine, wherein the resistance measuring reference cell is constituted by a section of a duct for distributing oil to the bearings of the engine crankshaft from said oil pump, the cell having electrodes between which the resistance of the oil is measured, constituted respectively by the duct wall and an internal electrode within the duct.

6. A lubrication monitoring device as defined in claim 5, wherein the internal electrode of said cell is in the form of a hollow cylinder located coaxially within the duct.

7. A lubrication monitoring device as defined in claim 4, wherein the said heating element is located on the outside of said reference cell.

* * * * *